US009640092B1

(12) United States Patent
VonCannon

(10) Patent No.: US 9,640,092 B1
(45) Date of Patent: May 2, 2017

(54) TORSION CLIP ASSEMBLY AND METHOD FOR DISPLAYING FOOD ITEMS

(76) Inventor: Jeffrey L. VonCannon, Denver, NC (US)

( * ) Notice: Subject to any disclaimer, the term of this patent is extended or adjusted under 35 U.S.C. 154(b) by 798 days.

(21) Appl. No.: 13/433,874

(22) Filed: Mar. 29, 2012

Related U.S. Application Data

(60) Provisional application No. 61/516,015, filed on Mar. 29, 2011.

(51) Int. Cl.
*G09F 3/20* (2006.01)
*G09F 3/16* (2006.01)

(52) U.S. Cl.
CPC ..... *G09F 3/16* (2013.01)

(58) Field of Classification Search
CPC ..... G09F 3/16
USPC ..... 40/659, 652, 647, 666, 658, 324, 306; 24/67.9, 336, 531, 546, 547
See application file for complete search history.

(56) References Cited

U.S. PATENT DOCUMENTS

| | | | | | |
|---|---|---|---|---|---|
| 227,507 | A | * | 5/1880 | Emerson | 40/658 |
| 302,853 | A | * | 7/1884 | Leonard | 40/659 |
| 675,761 | A | | 6/1901 | Vaaler | |
| 689,689 | A | * | 12/1901 | Parker et al. | 40/659 |
| 862,024 | A | * | 7/1907 | Senf | 248/229.26 |
| 1,273,721 | A | * | 7/1918 | Benway | 40/659 |
| 1,331,251 | A | * | 2/1920 | Evans | 40/311 |
| 1,839,016 | A | * | 12/1931 | Dodd | 248/488 |
| 1,922,900 | A | * | 8/1933 | Plante | 40/659 |
| 2,924,901 | A | * | 2/1960 | Paul | 40/307 |
| 3,398,475 | A | * | 8/1968 | Palmer | 40/658 |
| 4,236,331 | A | | 12/1980 | Mattson | |
| 4,277,864 | A | | 7/1981 | Orson, Sr. | |
| 4,338,737 | A | | 7/1982 | Lehmann | |
| 4,882,862 | A | * | 11/1989 | Slavsky, Sr. | 40/324 |
| 5,369,899 | A | | 12/1994 | Reeves | |
| 6,006,455 | A | | 12/1999 | Miller | |

* cited by examiner

*Primary Examiner* — Kristina Junge
(74) *Attorney, Agent, or Firm* — Schwartz Law Firm, P.C.

(57) ABSTRACT

A placard clip assembly includes a torsion placard clip, and a container clip for releasably attaching the torsion placard clip to an adjacent surface. The torsion placard clip includes first and second elongated overlying tongues integrally formed together at a torsion joint, and defining an expandable space therebetween for receiving and frictionally engaging a display placard.

7 Claims, 17 Drawing Sheets

TORSION CLIP ASSEMBLY AND METHOD FOR DISPLAYING FOOD ITEMS

TECHNICAL FIELD AND BACKGROUND OF THE INVENTION

This invention relates generally to a torsion clip assembly and method for displaying food items. In one exemplary application, the present disclosures utilizes torsion, elasticity, and friction to hold a display placard proximate a spaced-apart article, such as a food container.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a placard clip assembly including a torsion placard clip and means for releasably attaching the torsion placard clip to an adjacent surface, such as the edge of a food container. The torsion placard clip comprises first and second elongated overlying tongues integrally formed together at a torsion joint, and defining an expandable space therebetween for receiving and frictionally engaging a display placard.

The term "display placard" is defined broadly herein to mean a structure of any geometric shape having a surface suitable for being printed or written upon, or for carrying images, artwork, photographs or the like.

According to another exemplary embodiment, the torsion joint comprises an arcuate bend integrally connecting the first and second tongues together.

According to another exemplary embodiment, each of the first and second tongues comprises opposing spaced-apart straight wire sections.

According to another exemplary embodiment, the first and second tongues are of substantially unequal length.

According to another exemplary embodiment, respective ends of the first and second tongues opposite the torsion joint comprise respective arcuate bends.

According to another exemplary embodiment, the means for releasably attaching comprises a spring container clip integrally formed with the torsion placard clip.

According to another exemplary embodiment, the spring container clip comprises first and second elongated tongues integrally formed together at a spring joint, and defining an expandable space therebetween for receiving and frictionally engaging a food container.

According to another exemplary embodiment, the elongated tongues of the spring container clip extend substantially perpendicular to the elongated tongues of the torsion placard clip.

According to another exemplary embodiment, the elongated tongues of the spring container clip define a substantially triangular space therebetween for receiving and frictionally engaging the food container.

According to another exemplary embodiment, the torsion placard clip and the spring container clip are integrally formed together of a single steel wire.

According to another exemplary embodiment, the means for releasably attaching comprises a torsion container clip integrally formed with the torsion placard clip, and comprising a plurality of elongated overlying tongues.

According to another exemplary embodiment, an elongated spacer integrally connects the torsion placard clip and the torsion container clip.

According to another exemplary embodiment, the elongated tongues of the torsion container clip extend substantially parallel to the elongated tongues of the torsion placard clip.

According to another exemplary embodiment, adjacent overlying tongues of the torsion container clip are integrally connected together at a torsion joint, and define an expandable space therebetween for receiving and frictionally engaging a food container.

According to another exemplary embodiment, at least one of the overlying tongues is of substantially unequal length compared to the other overlying tongues.

According to another exemplary embodiment, the torsion placard clip and the torsion container clip are integrally formed together of a single steel wire.

According to another exemplary embodiment, the means for releasably attaching comprises a suction cup.

According to another exemplary embodiment, an elongated spacer interconnects the torsion placard clip and the suction cup.

In another exemplary embodiment, the present disclosure comprises a placard clip assembly in combination with a food container. The placard clip assembly comprises a torsion placard clip, and means for releasably attaching said torsion placard clip to said food container. The torsion placard clip comprises first and second elongated overlying tongues integrally formed together at a torsion joint, and defining an expandable space therebetween for receiving and frictionally engaging a display placard.

The term "food container" is defined broadly herein to mean any structure suitable for holding, carrying or containing a food item. The food item may comprise, for example, substantially solid food items, loose items, and liquids, such as soups, broths, and beverages.

In yet another exemplary embodiment, the present disclosures comprises a method for displaying (or presenting or serving) food items. The method includes locating a food item in a food container, and releasably attaching a placard clip assembly to the food container. The placard clip assembly may comprise a torsion placard clip including first and second elongated overlying tongues integrally formed together at a torsion joint. Information concerning the food item is provided on a display placard. The display placard is then inserted between overlying tongues of the placard clip assembly, thereby displaying the information provided on the display placard proximate the food container.

BRIEF DESCRIPTION OF THE DRAWINGS

Exemplary embodiments of the present invention will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
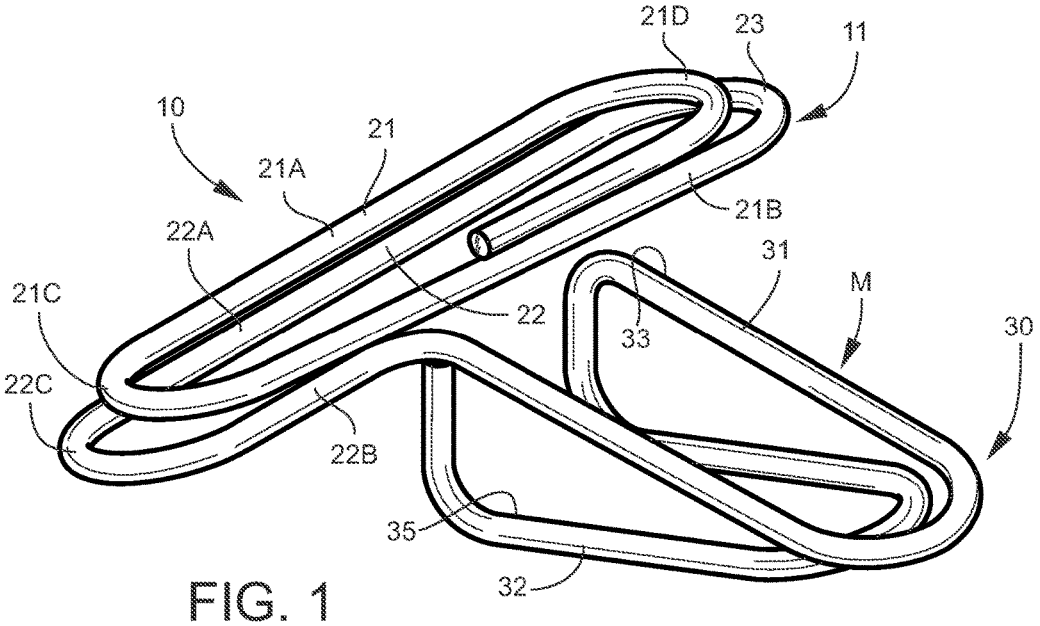
FIG. 1 is a perspective view of a placard clip assembly according to one exemplary embodiment of the present disclosure.
Figure 4:
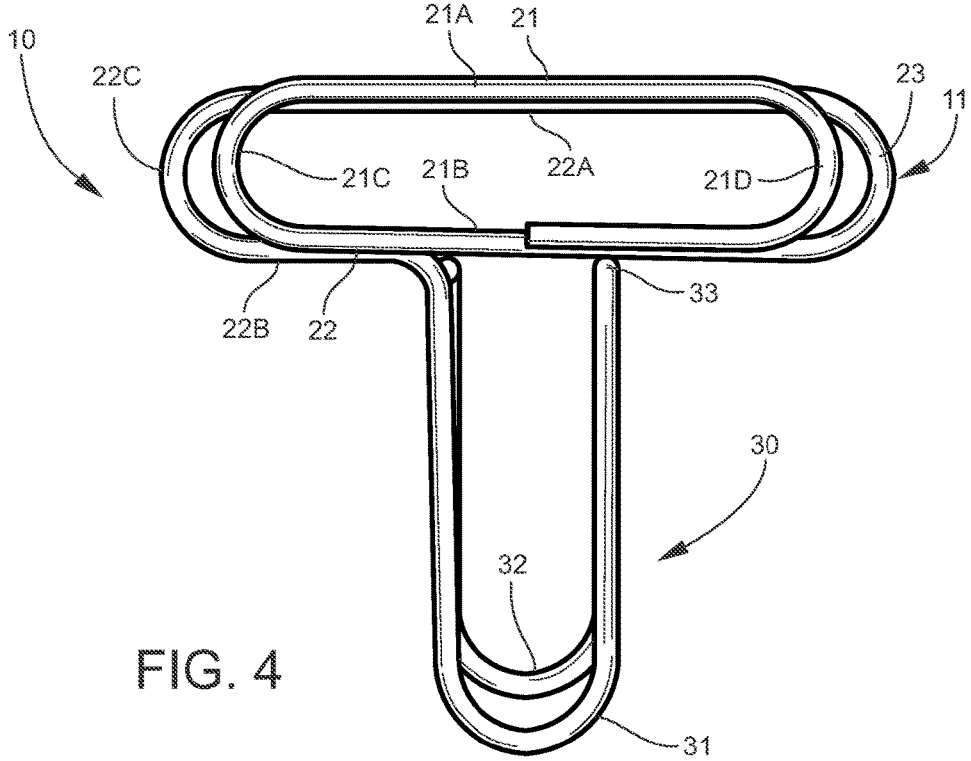
FIG. 4 is a top view of the exemplary placard clip assembly.
Figure 2:
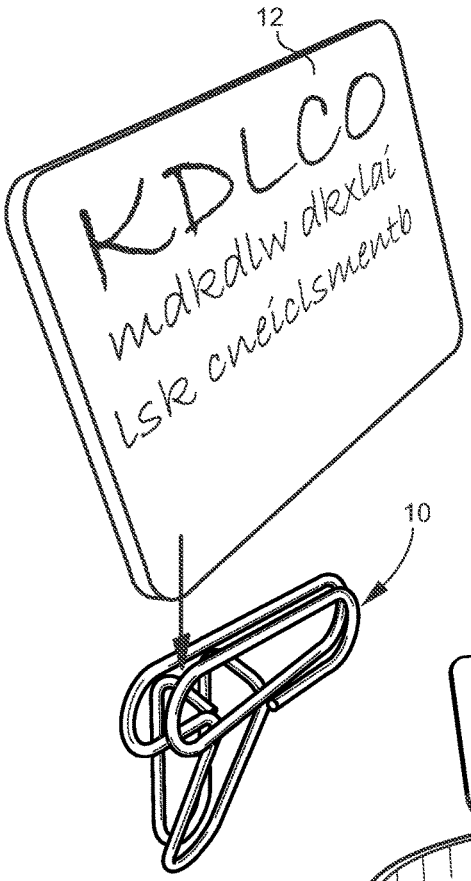
FIG. 2 is a further perspective view of the exemplary clip assembly, and demonstrating insertion of the display placard between overlying tongues of the torsion clip.
Figure 3:
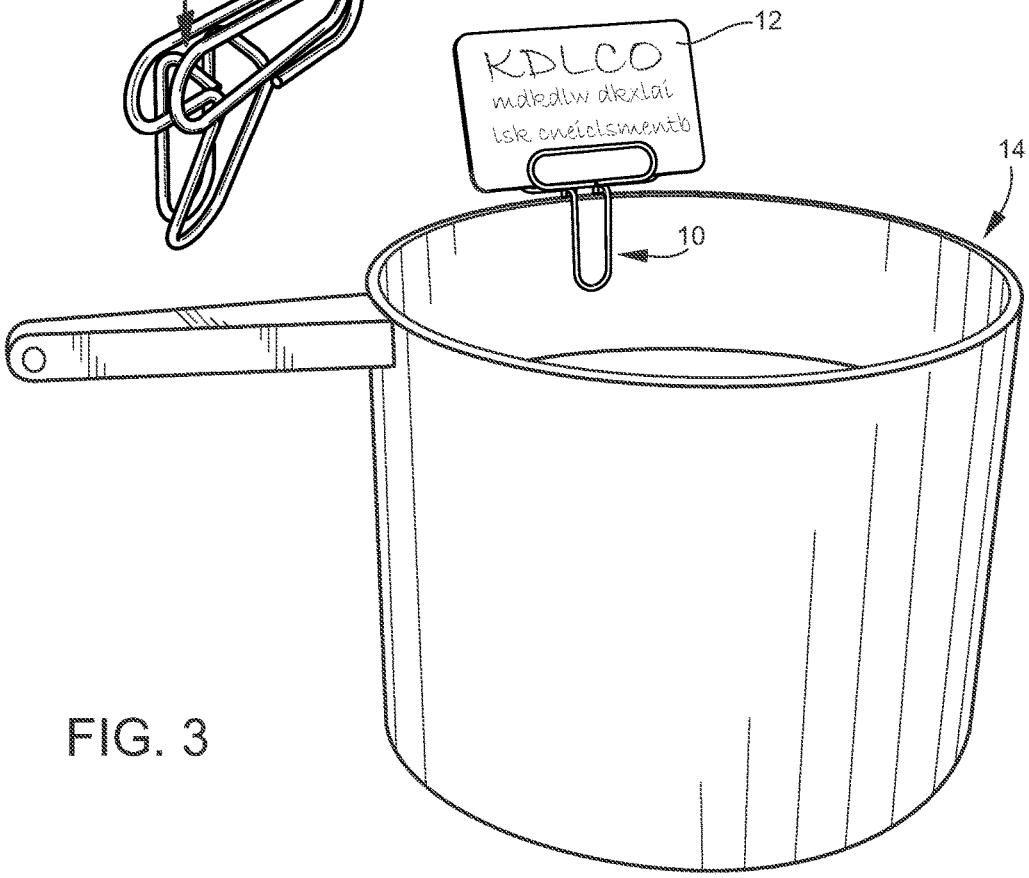
FIG. 3 shows the exemplary placard clip assembly attached to the edge of a food container, and holding the display placard proximate the container.
Figure 5:
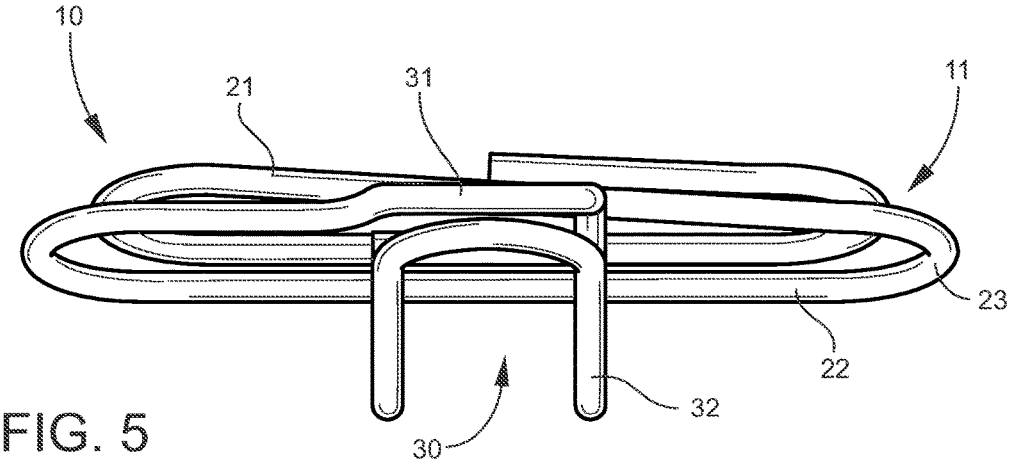
FIG. 5 is a rear end view of the exemplary placard clip assembly.
Figure 6:
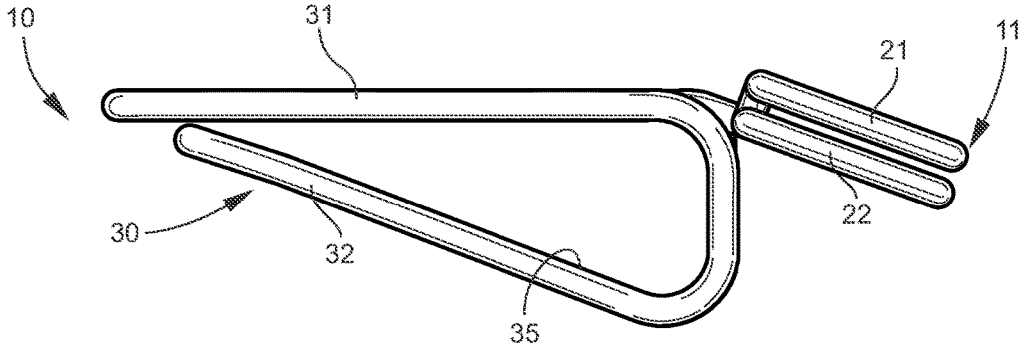
FIG. 6 is a right side of the exemplary placard clip assembly.
Figure 7:
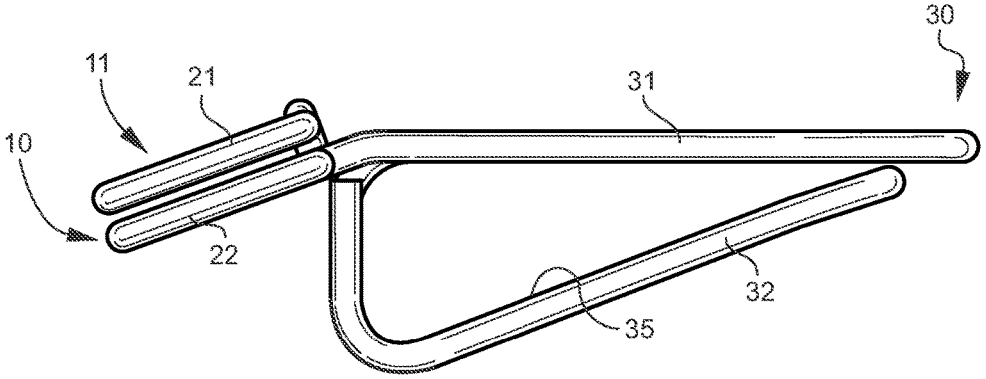
FIG. 7 is a left side view of the exemplary placard clip assembly.
Figure 8:
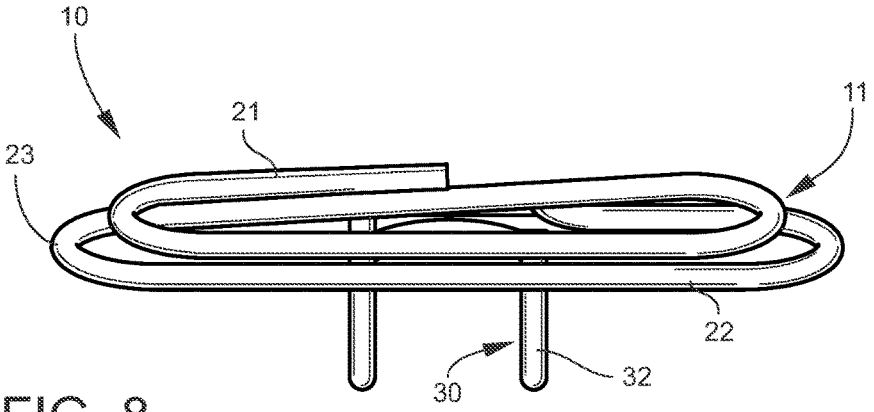
FIG. 8 is a front view of the exemplary placard clip assembly.
Figure 9:
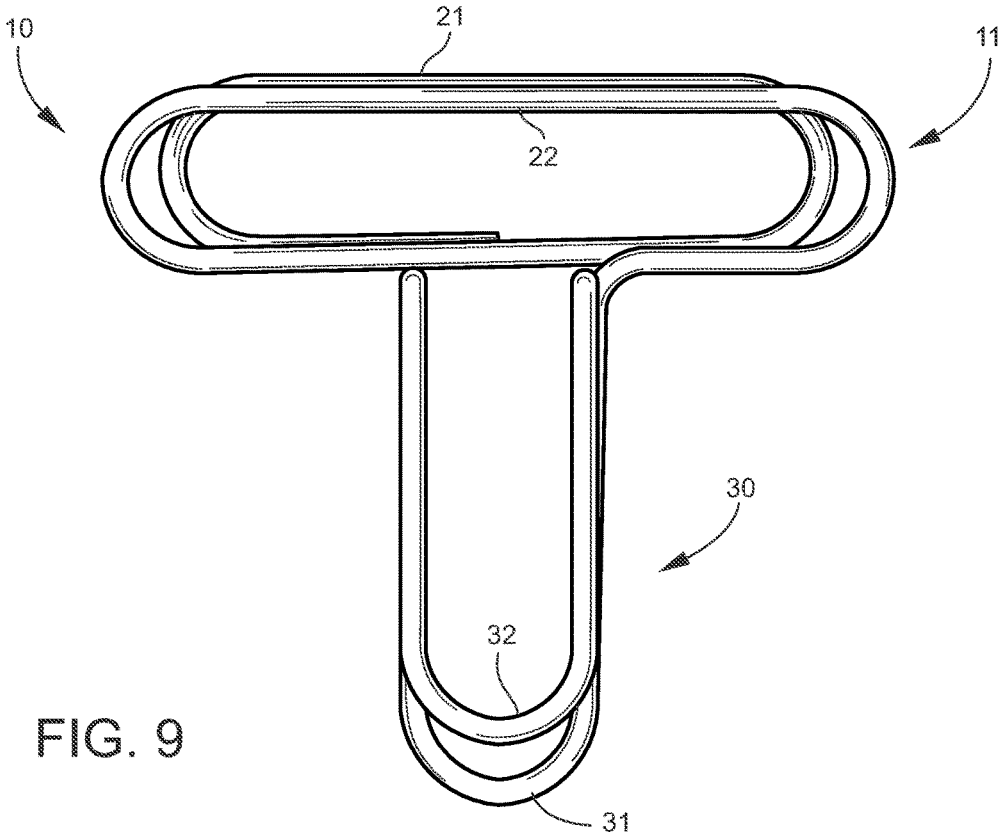
FIG. 9 is a bottom view of the exemplary placard clip assembly.

Referring now specifically to the drawings, a placard clip assembly according to one exemplary embodiment of the present disclosure is illustrated in FIGS. 1-9, and shown generally at reference numeral 10. The exemplary clip assembly 10 comprises a torsion placard clip 11, and attachment means (shown generally at "M") for releasably attaching the torsion placard clip 11 to an adjacent surface. In an exemplary implementation, the clip assembly 10 frictionally holds a display placard 12 and is designed to releasably attach to an edge of a food container 14, such as the pot illustrated in FIG. 2. The display placard 12 may be constructed of a relatively thin high-impact polyurethane, durable card stock or other paper product, or other suitable material or structure having a relatively flat writable surface. In the example of FIGS. 2 and 3, food-identifying text or indicia may be applied or handwritten onto the display placard 12 using a wet-erase or other such marker. The food-identifying text or indicia may comprise, for example, the name of the food item (e.g., "Eggplant Lasagna"), serving price, a listing of main ingredients, a food recipe, a statement regarding food allergies (e.g., "contains peanuts and/or tree nuts"), create artwork and images, the name and/or photograph of the preparer, or other text or indicia pertinent to the displayed food item.

As best shown in FIGS. 1, 2 and 4-9, the torsion placard clip 11 and attachments means "M" of the exemplary clip assembly 10 are integrally constructed of a single, homogenous bent steel wire. The placard clip 11 comprises first and second elongated (generally oval or oblong) overlying tongues 21, 22 integrally connected together at a torsion joint 23, and having sufficient elasticity when forced apart for receiving and frictionally holding the display placard 12. FIG. 2 demonstrates opening of the expandable space between the overlying tongues 21, 22 to receive the display placard 12. The torsion joint 23 integrally joins the overlying tongues 21, 22, as indicated previously, and forms a proximal arcuate bend at one end of the placard clip 11. The overlying tongues 21, 22 comprise respective pairs of straight wire sections 21A, 21B and 22A, 22B, and respective arcuate distal bends 21C, 22C opposite the torsion joint 23. The first (or "top") tongue 21 may be shorter in length compared to the second (or "bottom") tongue 22, and may include an additional arcuate bend 21D adjacent the arcuate torsion joint 23.

Figure 10A:
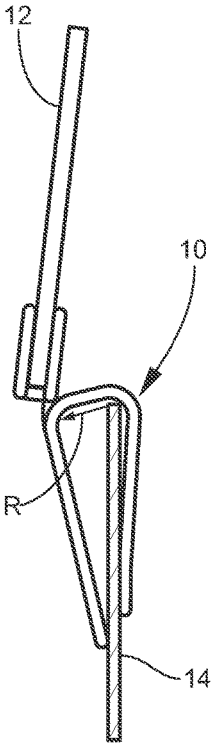
FIGS. 10A, 10B, and 10C are views illustrating a range of tilt adjustment of the display placard.
Figure 10B:
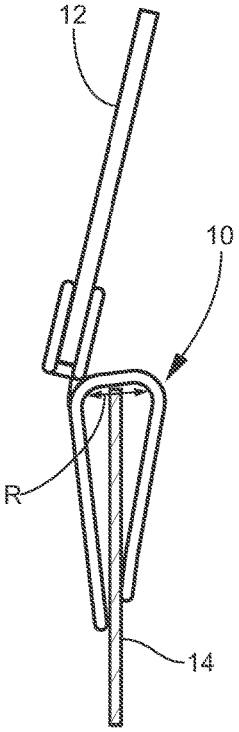
Figure 10C:
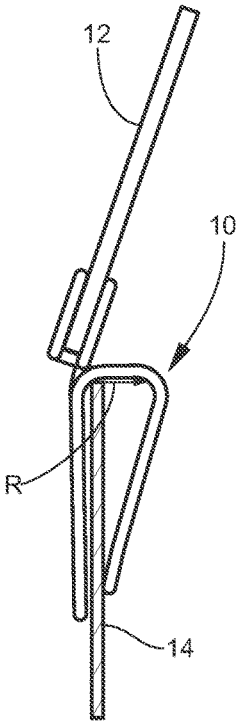
Figure 11:
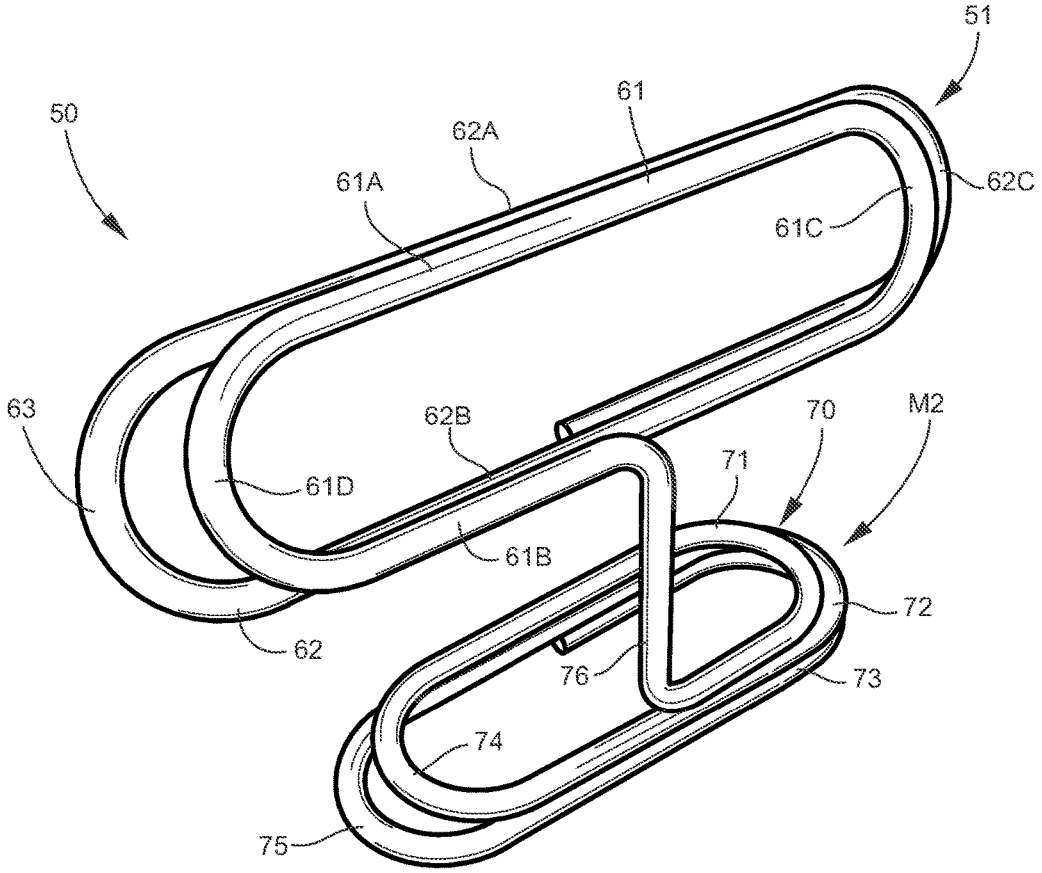
FIG. 11 is a perspective view of a placard clip assembly according to another exemplary embodiment of the present disclosure.
Figure 12:
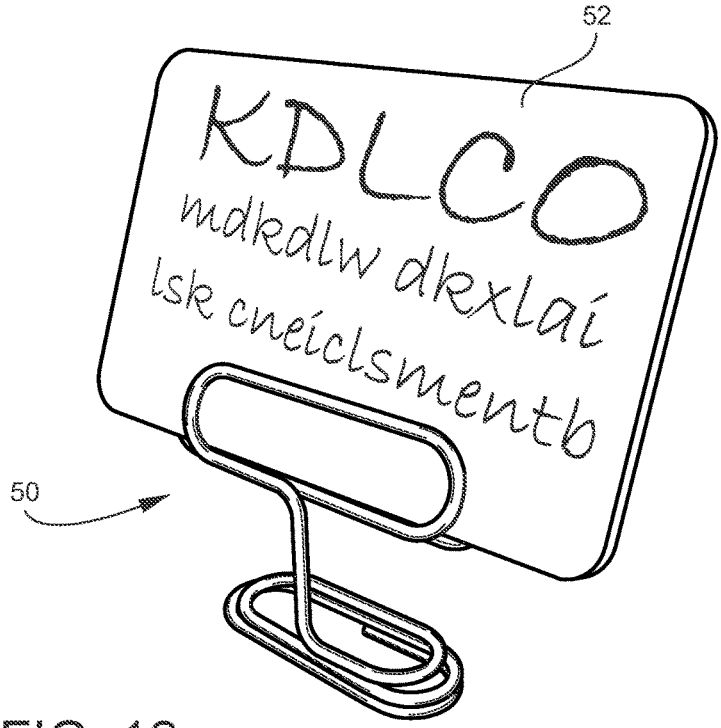
FIG. 12 is a further perspective view of the exemplary clip assembly, and showing the display placard frictionally held between overlying tongues of the torsion clip.
Figure 13:
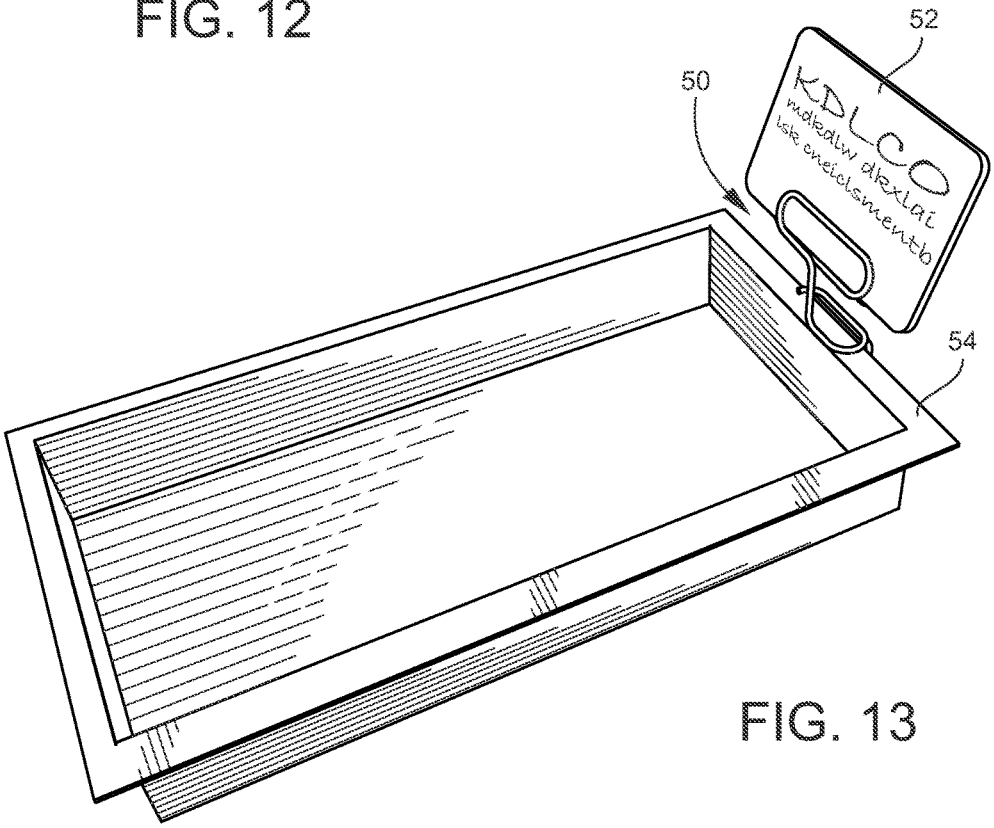
FIG. 13 shows the exemplary placard clip assembly attached to the edge of a food container, and holding the display placard proximate the container.
Figure 14:
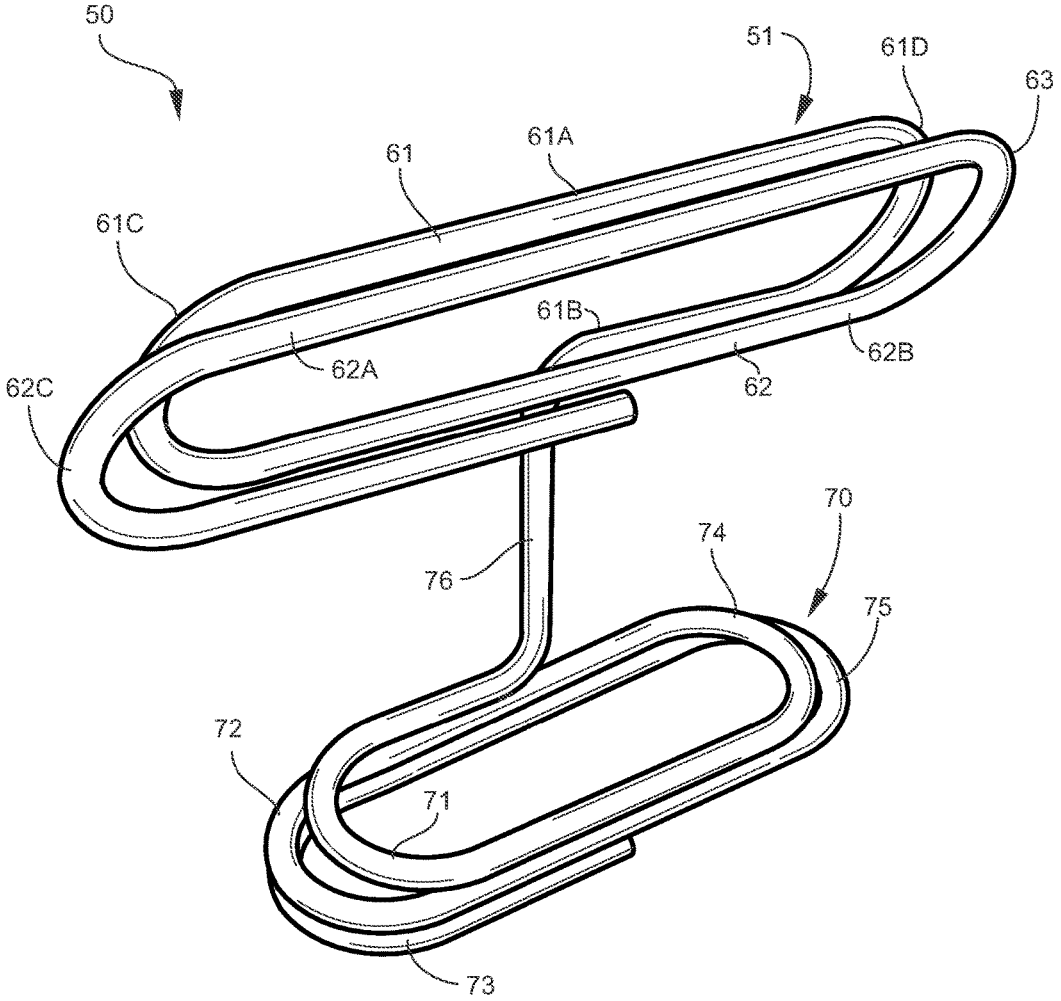
FIG. 14 is a rear perspective view of the exemplary placard clip assembly.
Figure 15:
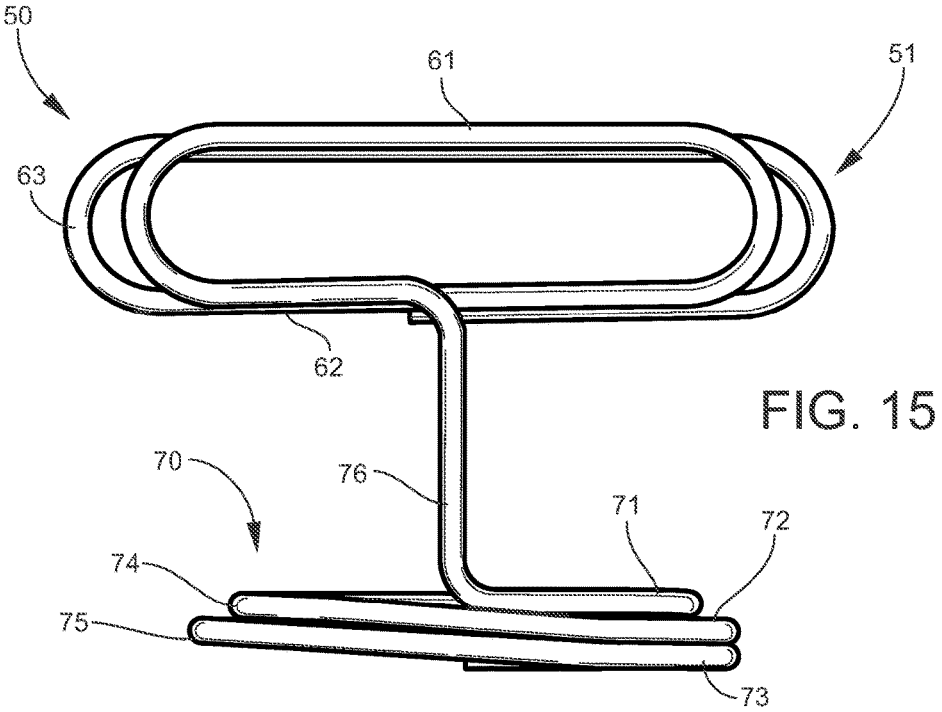
FIG. 15 is a front view of the exemplary placard clip assembly.
Figure 16:
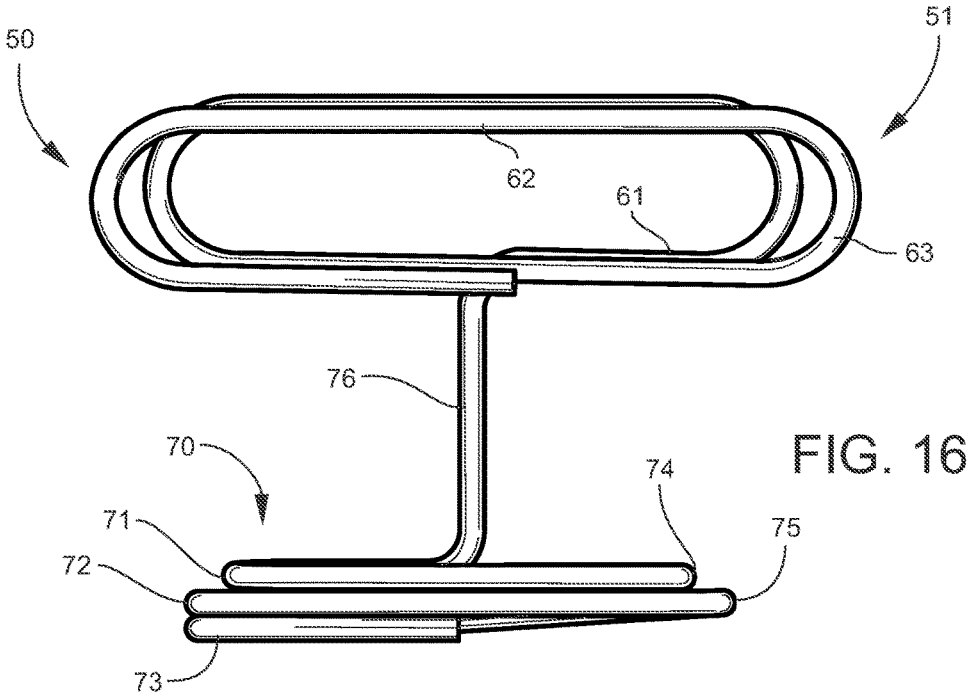
FIG. 16 is a rear view of the exemplary placard clip assembly.
Figure 17:
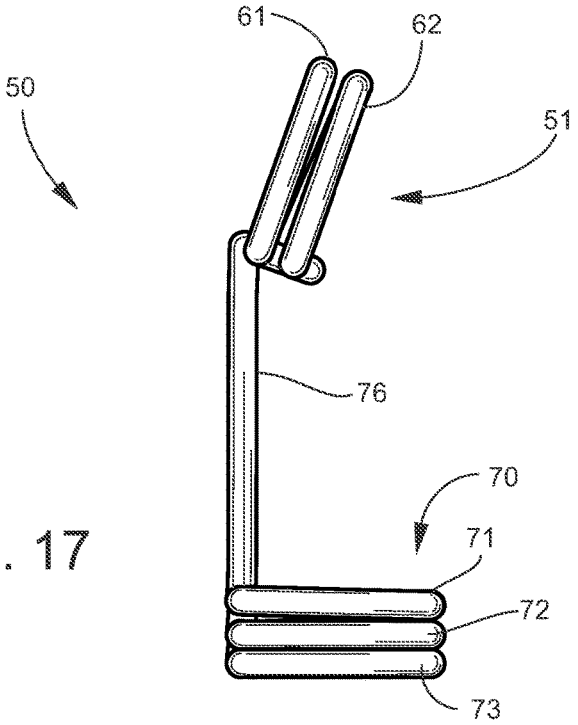
FIG. 17 is a right side of the exemplary placard clip assembly.
Figure 18:
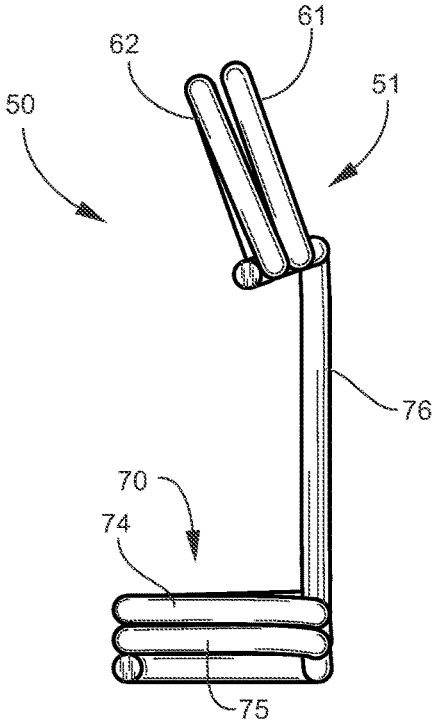
FIG. 18 is a left side view of the exemplary placard clip assembly.
Figure 19:
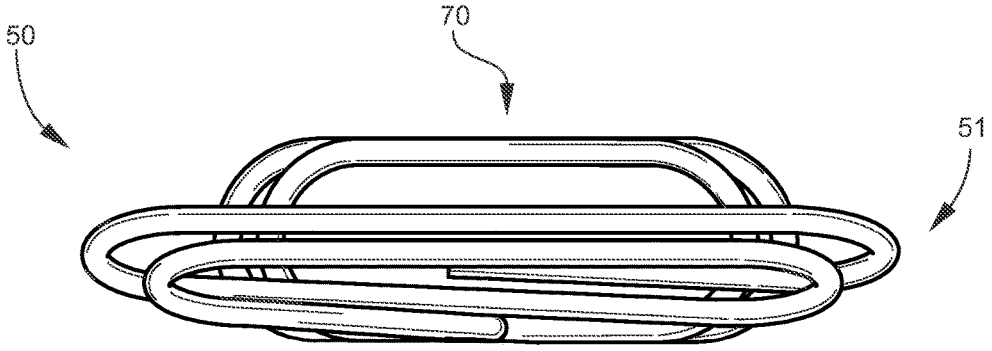
FIG. 19 is a top view of the exemplary placard clip assembly.
Figure 20:
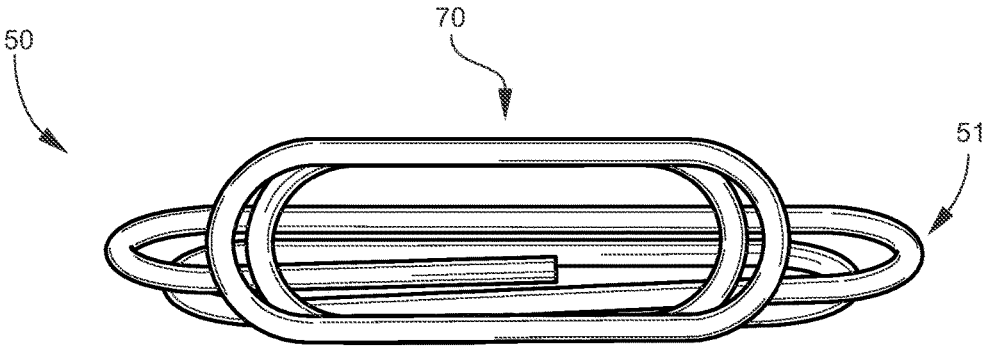
FIG. 20 is a bottom view of the exemplary placard clip assembly.
Figure 21:
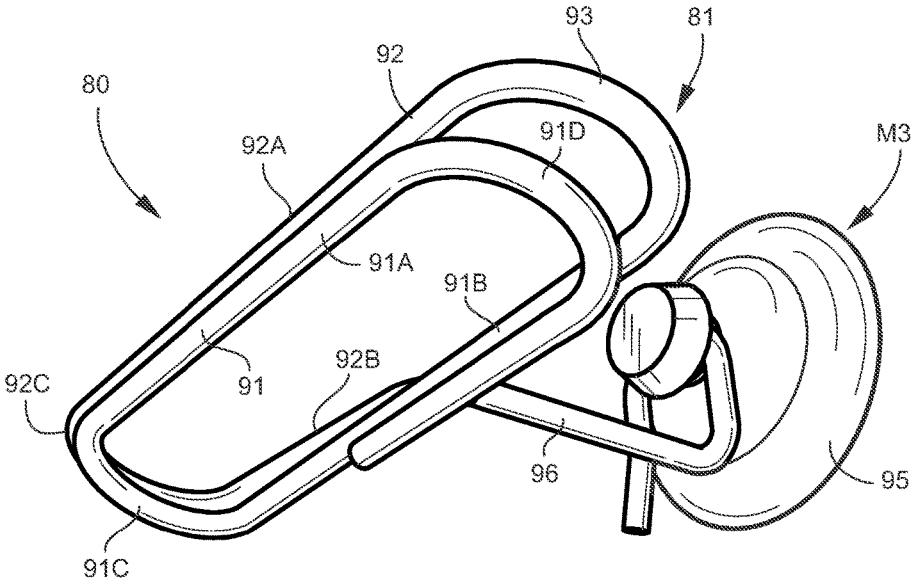
FIG. 21 is a perspective view of a placard clip assembly according to another exemplary embodiment of the present disclosure.
Figure 22:
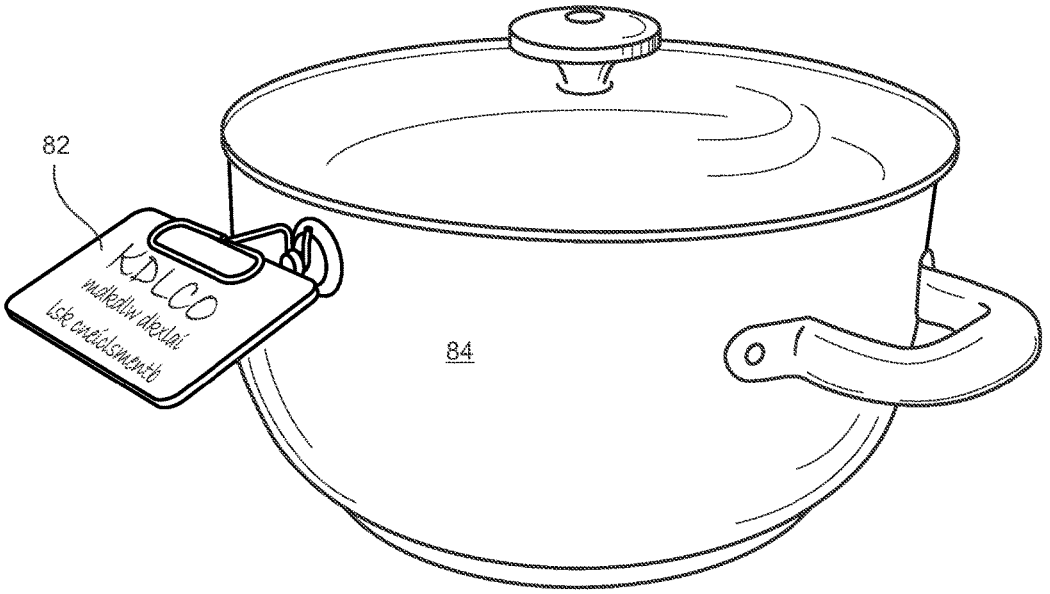
FIG. 22 shows the exemplary placard clip assembly attached to the edge of a food container, and holding the display placard proximate the container.
Figure 23:
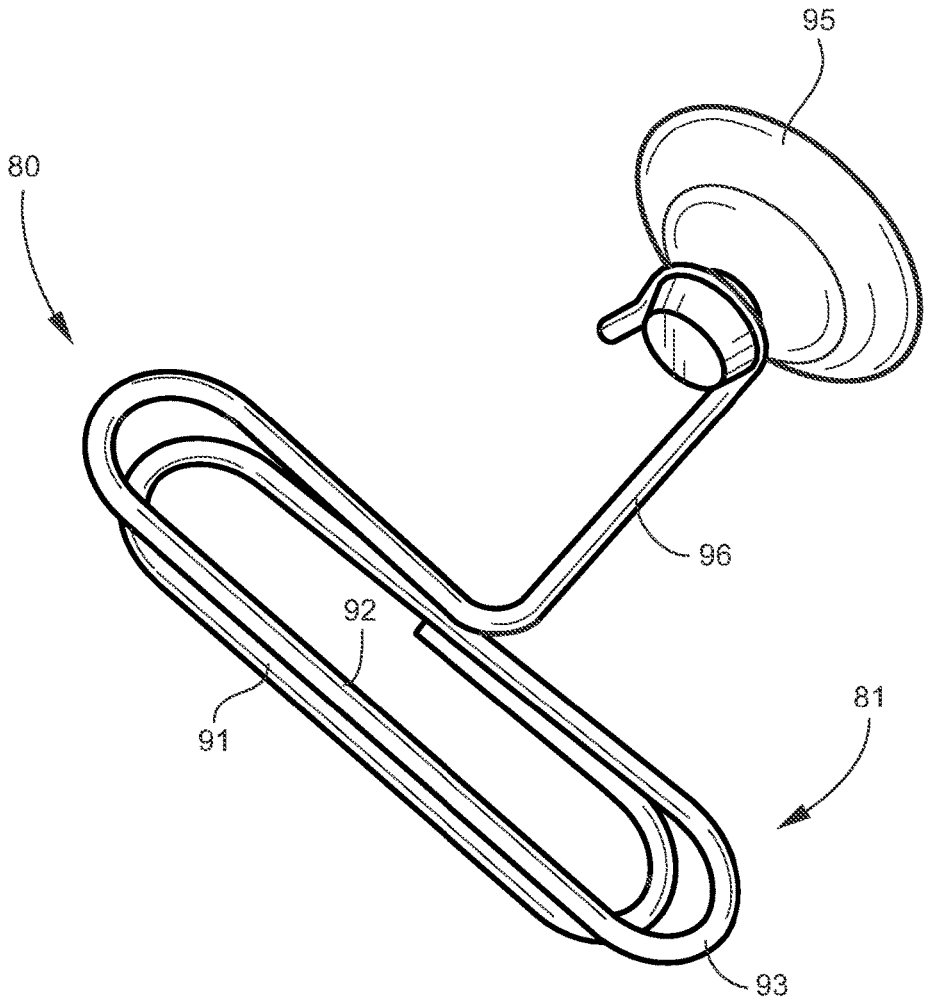
FIG. 23 is a further perspective view of the exemplary placard clip assembly.
Figure 24:
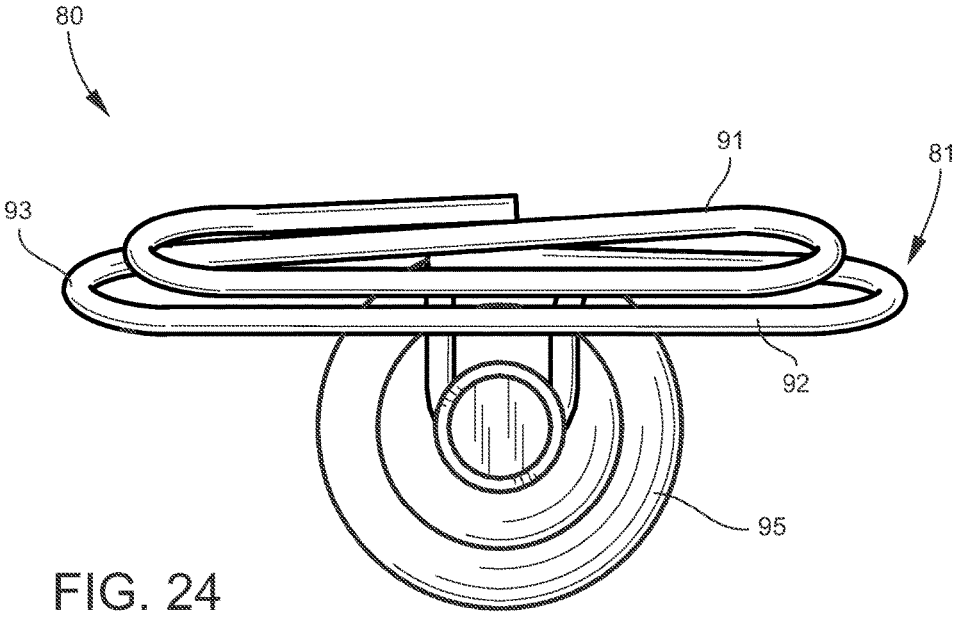
FIG. 24 is a front view of the exemplary placard clip assembly.
Figure 25:
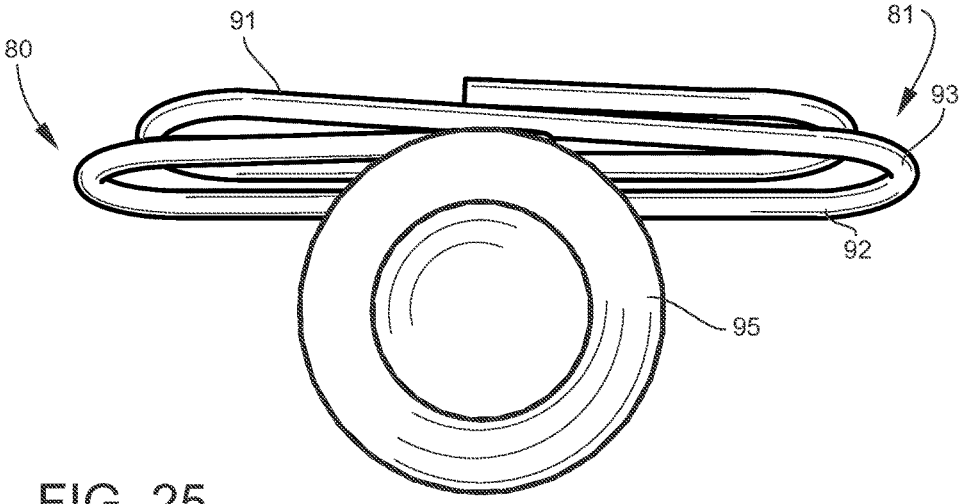
FIG. 25 is a rear view of the exemplary placard clip assembly.
Figure 26:
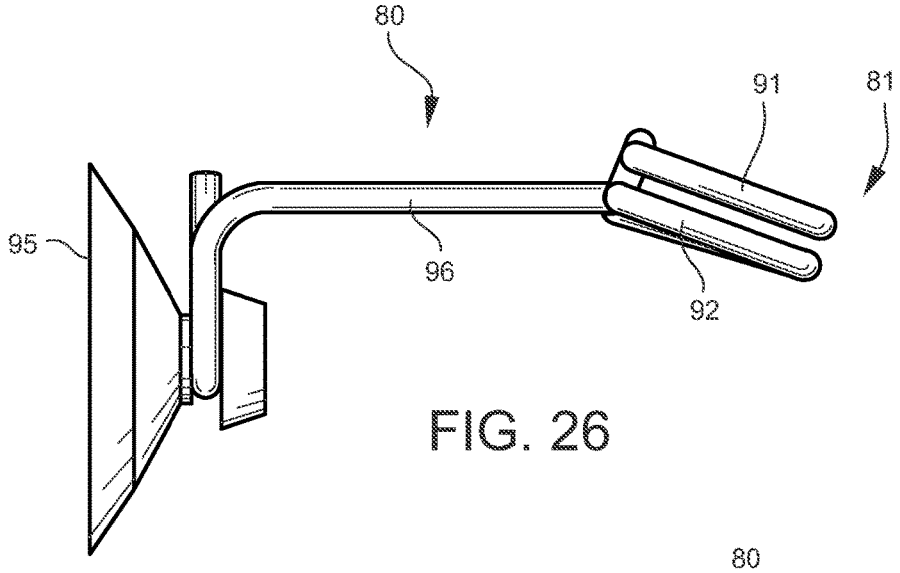
FIG. 26 is a right side of the exemplary placard clip assembly.
Figure 27:
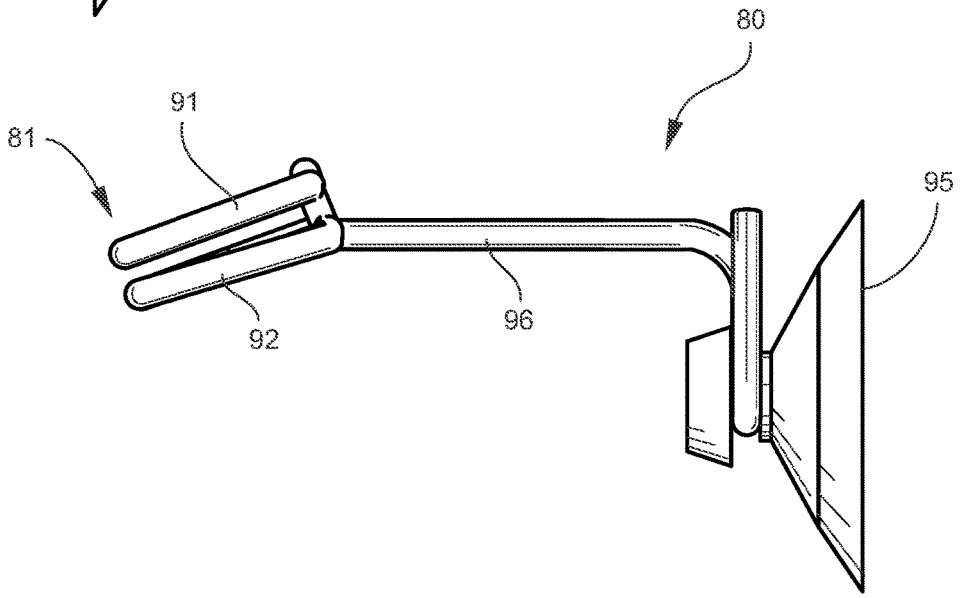
FIG. 27 is a left side view of the exemplary placard clip assembly.
Figure 28:
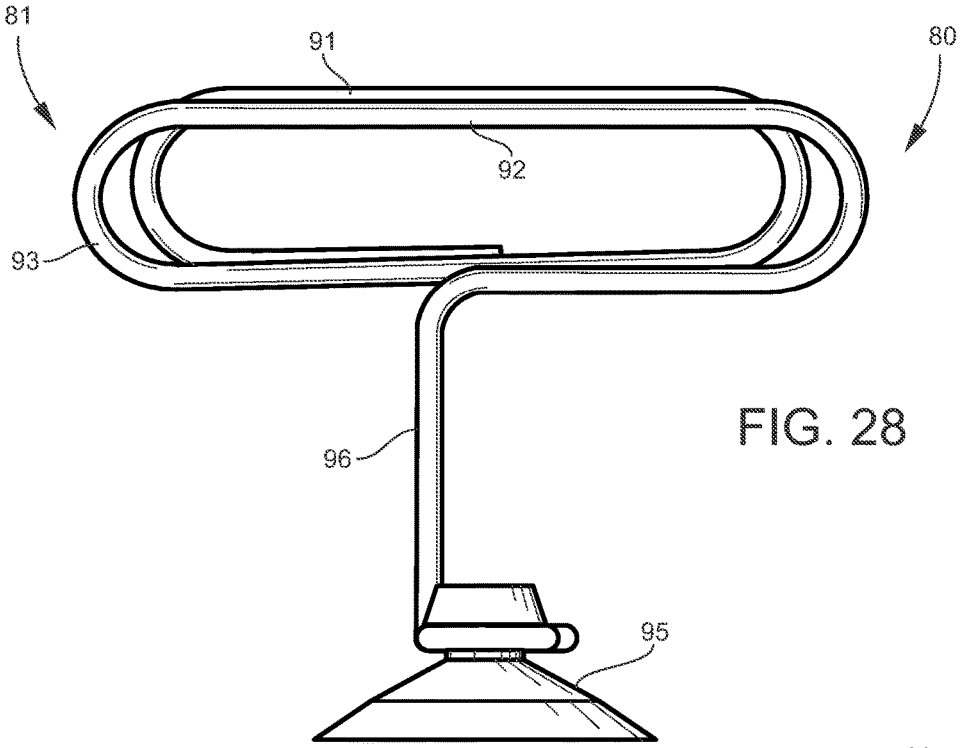
FIG. 28 is a bottom view of the exemplary placard clip assembly.
Figure 29:
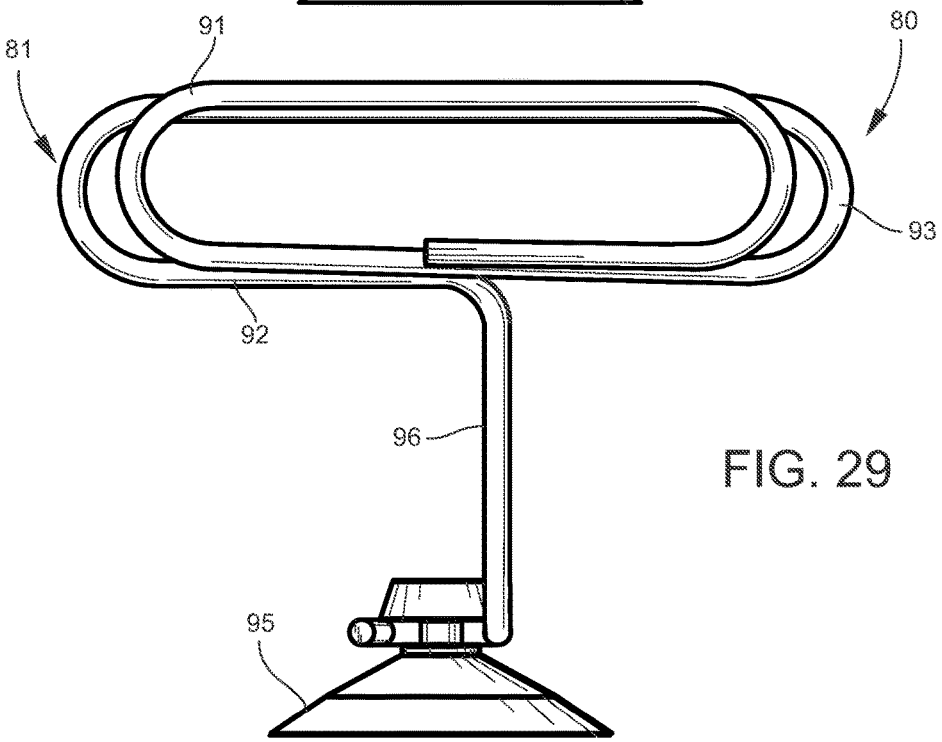
FIG. 29 is a top view of the exemplary placard clip assembly.
Figure 30:
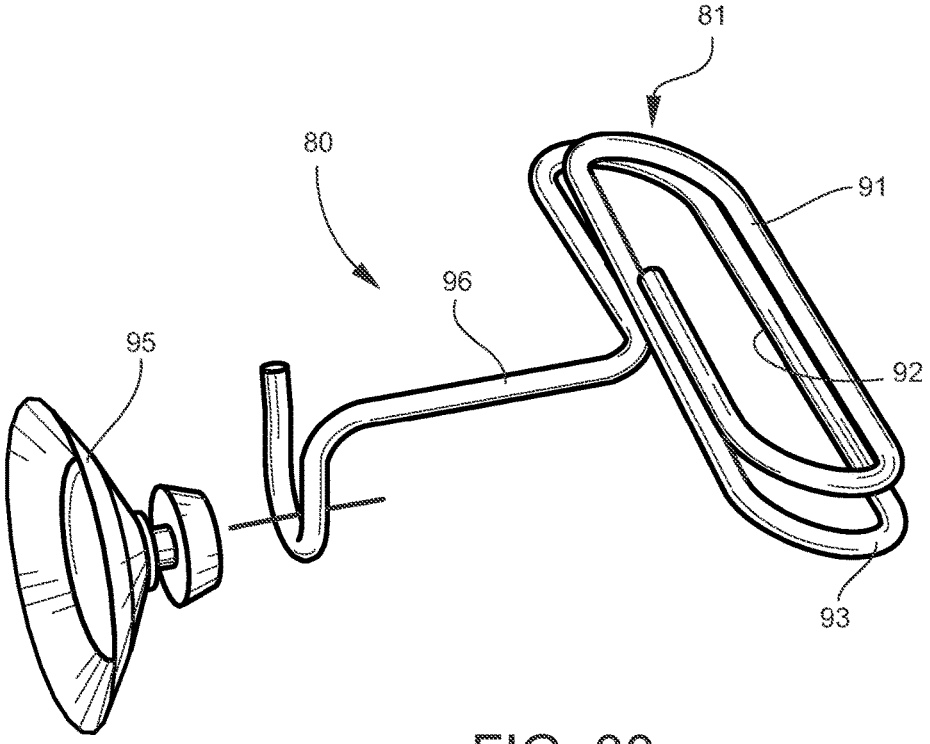
FIG. 30 is an exploded perspective view showing the suction cup of the placard clip assembly detached from the integral spacer.

In this exemplary embodiment, the attachment means "M" comprises a releaseable spring container clip 31 integrally formed with the torsion placard clip 11. The spring container clip 30 includes first and second elongated tongues 31, 32 integrally formed together at a spring joint 33, and having sufficient elasticity to expand (force apart), receive, and frictionally engage an edge of the food container 14. The elongated tongues 31, 32 of the exemplary spring container clip 30 extend substantially perpendicular to the elongated tongues 21, 22 of the torsion placard clip 11, and define a substantially triangular space 35 therebetween. As demonstrated in FIGS. 10A, 10B, and 10C, the triangular space 35 enables a range "R" of tilt adjustment relative to the fixed edge of container 14 for adjusting the display angle of the placard 12.

A further exemplary embodiment of the present disclosure is illustrated in FIGS. 11-20. The exemplary placard clip assembly 50 comprises a torsion placard clip 51 and attachment means "M2". The clip assembly 50 frictionally holds a display placard 52, and is designed to releasably attach to an edge of a food container 54, such as the pan illustrated in FIG. 12. The display placard 52 may be constructed, as described above, and may include food-identifying text or other indicia including images, artwork, photographs, and the like.

Like clip assembly 10 previous described, the torsion placard clip 51 and attachment means "M2" of the exemplary clip assembly 50 are integrally constructed of a single, homogenous bent steel wire. The placard clip 51 comprises first and second elongated (generally oval or oblong) overlying tongues 61, 62 integrally connected together at a torsion joint 63, and having sufficient elasticity when forced apart for receiving and frictionally holding the display placard 52. See FIGS. 12 and 13. The torsion joint 63 integrally joins the overlying tongues 61, 62, and forms a proximal arcuate bend at one end of the placard clip 51. The overlying tongues 61, 62 comprise respective pairs of straight wire sections 61A, 61B and 62A, 62B, and respective arcuate distal bends 61C, 62C opposite the integral torsion joint 63. The first (or "top") tongue 61 may be shorter in length compared to the second (or "bottom") tongue 62, and may include an additional arcuate bend 61D adjacent the arcuate torsion joint 63.

In this exemplary embodiment, the attachment means "M2" comprises a releaseable torsion container clip 70 integrally formed with the torsion placard clip 51 and defining three elongated overlying tongues 71, 72, 73 integrally formed together at adjacent torsion joints 74, 75. Adjacent tongues 71-73 of the exemplary clip 70 have sufficient elasticity to expand (force apart), receive, and frictionally engage an edge of the food container 54. The tongues 71-73 extend substantially parallel to the elongated tongues 61, 62 of the torsion placard clip 51, and are spaced apart from the placard clip 51 by a perpendicular single-wire spacer 76. At least one of the overlying tongues 71-73 (e.g., top tongue 71) of the clip 70 is of substantially shorter length compared to the other overlying tongues 72, 73. Adjacent ones of the tongues 71-73 may be forced apart at either torsion joint 74, 75 to receive the food container 54.

Yet another exemplary embodiment of the present disclosure is illustrated in FIGS. 21-30. The exemplary placard clip assembly 80 comprises a torsion placard clip 81 and attachment means "M3". The clip assembly 80 frictionally holds a display placard 82, and is designed to releasably attach to an edge of a food container 84, such as the ceramic or glass bowl illustrated in FIG. 22. The display placard 82 may be constructed, as described above, and may include food-identifying text or other indicia including images, artwork, photographs, and the like.

As previously described, the placard clip 81 comprises first and second elongated (generally oval or oblong) overlying tongues 91, 92 integrally connected together at a torsion joint 93, and having sufficient elasticity when forced apart for receiving and frictionally holding the display placard 82. The torsion joint 93 integrally joins the overlying tongues 91, 92, and forms a proximal arcuate bend at one end of the placard clip 81. The overlying tongues 91, 92 comprise respective pairs of straight wire sections 91A, 91B and 92A, 92B, and respective arcuate distal bends 91C, 92C opposite the torsion joint 93. The first (or "top") tongue 91 may be shorter in length compared to the second (or "bottom") tongue 92, and may include an additional arcuate bend 91D adjacent the arcuate torsion joint 93.

In this exemplary embodiment, the attachment means "M3" comprises a releaseable elastic suction cup 95. The suction cup 95 is attached to the distal end (or hook end) of an elongated spacer 96. The placard display clip 81 and spacer 96 may be integrally formed together of a single, homogenous bent steel wire.

In other exemplary embodiments (not shown), the placard clip assembly may be fabricated, in whole or partially, of a molded plastic, and may comprises overlying tongues of any geometric shape including triangular, circular, elliptical, square and others. The placard clip assembly may also incorporate a multiple-piece clamping system for releasably attaching to the food container, or for releasably holding the display placard. In the single steel-wire constructions described above, the placard clip assembly may also comprise colored or multi-colored plastic coatings.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed:

1. A placard clip assembly, comprising:

a torsion placard clip comprising first and second elongated overlying tongues integrally formed together at a torsion joint and defining an expandable space therebetween for receiving and frictionally engaging a display placard; and a spring container clip integrally formed with said torsion placard clip, and comprising first and second elongated tongues having respective converging substantially U-shaped distal ends extending substantially perpendicular to the elongated tongues of said torsion placard clip and integrally formed together at a spring joint; and said spring container clip defining an expandable and substantially triangular space between the converging substantially U-shaped distal ends of said first and second tongues for receiving and frictionally engaging a food container, whereby the triangular space enables a range of tilt adjustment relative to the food container for adjusting a display angle of the placard.

2. The placard clip assembly according to claim 1, wherein said torsion joint comprises an arcuate bend integrally connecting together said first and second tongues of said torsion placard clip.

3. The placard clip assembly according to claim 1, wherein each of said first and second tongues of said torsion placard clip comprises opposing spaced-apart straight wire sections.

4. The placard clip assembly according to claim 1, wherein said first and second tongues of said torsion placard clip are of substantially unequal length.

5. The placard clip assembly according to claim 1, wherein respective ends of said first and second tongues of said torsion placard clip opposite said torsion joint comprise respective arcuate bends.

6. The placard clip assembly according to claim 1, wherein said torsion placard clip and said spring container clip are integrally formed together of a single steel wire.

7. In combination with a food container, a placard clip assembly comprising:

a torsion placard clip comprising first and second elongated overlying tongues integrally formed together at a torsion joint and defining an expandable space therebetween for receiving and frictionally engaging a display placard; and a spring container clip integrally formed with said torsion placard clip, and comprising first and second elongated tongues having respective converging substantially U-shaped distal ends extending substantially perpendicular to the elongated tongues of said torsion placard clip and integrally formed together at a spring joint; and said spring container clip defining an expandable and substantially triangular space between the converging substantially U-shaped distal ends of said first and second tongues for receiving and frictionally engaging said food container, whereby the triangular space enables a range of tilt adjustment relative to said food container for adjusting a display angle of the placard.

* * * * *